US006507537B1

(12) United States Patent
Jujo

(10) Patent No.: US 6,507,537 B1
(45) Date of Patent: Jan. 14, 2003

(54) POWER RESERVE MECHANISM

(75) Inventor: Koichiro Jujo, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/582,362

(22) PCT Filed: Dec. 24, 1998

(86) PCT No.: PCT/JP98/65939

§ 371 (c)(1),
(2), (4) Date: Aug. 29, 2000

(87) PCT Pub. No.: WO99/34261

PCT Pub. Date: Jul. 8, 1999

(30) Foreign Application Priority Data

Dec. 25, 1997 (JP) ..... 9-358076

(51) Int. Cl.[7] ..... G04B 9/00; G04B 1/00; G04C 23/00

(52) U.S. Cl. ..... 368/66; 368/203

(58) Field of Search ..... 368/661, 140, 368/145, 210, 212, 203, 204

(56) References Cited

U.S. PATENT DOCUMENTS 5,828,628 A * 10/1998 Born et al. ..... 368/66

FOREIGN PATENT DOCUMENTS

| | | | |
|---|---|---|---|
| CH | 0329449 | 4/1958 | |
| FR | 2743906 | 7/1997 | |
| JP | 13010981 | 8/1938 | |
| JP | 10197653 | 7/1998 | ..... G04B/9/00 |

* cited by examiner

*Primary Examiner*—Vit Miska
(74) *Attorney, Agent, or Firm*—Adams & Wilks

(57) ABSTRACT

A power reserve mechanism has a ratchet wheel having a winding stem, a first winding stem train wheel connected to the winding stem of the ratchet wheel and having a first power reserve wheel, and a barrel member having a winding stem. A spring member is mounted in the barrel member. A second winding stem train wheel independent from the first winding stem train wheel is connected to the winding stem of the barrel member and has a second power reserve wheel. A first indicator is disposed on the first power reserve wheel. A second indicator is disposed on the second power reserve wheel. An amount of spring power stored by the spring member is indicated utilizing a relative variation in movement between the first and second indicators.

28 Claims, 7 Drawing Sheets

(a)

(b)

(c)

POWER RESERVE MECHANISM

BACKGROUND OF THE INVENTION

1. Field of the Invention

This invention relates to a power reserve mechanism and indicator unit for same and, more particularly, to a power reserve mechanism and indicator unit for same which indicates a power storage amount using two indicator hands and the like.

2. Background of the Invention

FIG. 6 is a sectional view showing a train wheel structure of a power reserve structure. FIG. 7 is a top view showing the train wheel of the power reserve structure shown in FIG. 6. The power reserve mechanism 500 train wheel is structured by a barrel complete 501 accommodating a spiral spring as a power source, a ratchet wheel 502 arranged on a dial side of the barrel complete 501, a intermediate planetary wheel gear 503 in mesh with the barrel complete 501, a planetary wheel 504 rotatably arranged in an eccentric part of the intermediate planetary wheel gear 503, a planetary wheel gear 505 and planetary pinion 506 fixed to the planetary wheel 504 in a form sandwiching the intermediate planetary wheel gear 503, a sun wheel 507 in mesh with the planetary pinion 506 of the planetary wheel 504, on the other hand a second sun wheel 508 in mesh with the planetary wheel gear 505 of the planetary wheel 504, a intermediate indicator wheel 510 in mesh with the sun pinion 509 of the sun wheel 507, a indicator wheel 512 in mesh with the intermediate indicator pinion 511 of the intermediate indicator wheel 510, and a intermediate planetary wheel 514 in mesh with the ratchet wheel 502 and the second sun wheel gear 513 of the second sun wheel 508.

A reference numeral 515 is an indication degree determining pin. The intermediate indicator wheel 510 is structured to slip at a contact point when a predetermined difference of torque is caused between the intermediate indicator wheel gear 5101 and the intermediate indicator wheel pinion 511. The indicator wheel 512 is provided with a fan-shaped cutout 516 to view the indication degree determining pin 515. The indication degree determining pin 515 is secured to a second wheel train bridge 601 to regulate an angle of rotation of the indicator wheel 512.

Next, the operation of the power reserve mechanism will be explained. When spring power to the spiral spring, the ratchet wheel 502 is first rotated through a crown, winding stem and crown wheel from an outside. Because the intermediate planetary wheel gear 503 is regulated in rotation by the barrel complete 501, the same intermediate planetary wheel gear 503 is a substantially fixing gear. The rotation of ratchet wheel 502 is transmitted through the intermediate planetary wheel 514, second sun gear 508, planetary gear 504, sun gear 507, intermediate indicator wheel 510 and indicator wheel 512, in this order. This causes the indicator wheel 512 to rotate leftward (reverse to a rotation direction in usual hand movement). The rotation of indicator wheel 512 causes the indicator hand 517 mounted on the indicator wheel 512 to rotate in a spiral spring power storing direction.

If the spiral spring achieves a fully wound state, the fan-shaped cutout 516 of the indicator wheel 512 and the indication degree determining pin 515 are brought into engagement to thereby regulate rotation of the indicator wheel 512. In this case, slip occurs at a contact plane between the intermediate indicator wheel gear 5101 and the intermediate indicator wheel pinion 510. Due to this, even if the crown is excessively wound, the indicator hand 517 is unchanged in position without imposing a load onto the train wheel.

Next, during usual movement of the hands, the power on the barrel complete 501 is transmitted from the barrel complete gear 5011 to the intermediate planetary wheel gear 503. On the other hand, the second sun wheel 508 coaxial to the intermediate planetary wheel gear 503 is in mesh with the ratchet wheel 502 through the intermediate planetary wheel 514. Because this ratchet wheel 502 is out of rotation during usual hand movement, the second sun wheel 508 is a fixing gear. Consequently, when the intermediate planetary gear wheel 503 rotates, the planetary wheel 504 of the intermediate planetary wheel gear 503 makes movement of rotation and revolution along the second sun wheel 508. Because the sun wheel gear 5072 and the planetary pinion 506 are secured on a sun stem 5071 and in mesh with each other, the rotation of planetary wheel 504 is transmitted to the indicator wheel 512 through the sun wheel gear 5072, sun stem 5071, sun pinion 509 and intermediate indicator wheel 510. The rightward rotation of indicator wheel 512 also rotates rightward the indicator hand 517 mounted on the indicator wheel 512. It will be understood that as this indicator hand 517 rotates rightward the power storage amount on the spiral spring decreases.

However, the prior art power reserve mechanism 500 using the planetary wheel gear mechanism comprising the planetary wheel 504, etc. have involved the following problems:

(1) cost increase because of increased number of movement parts, (2) difficult and troublesome assembling because of increased number of movement assembling steps;

(3) reduced freedom in method of indicating a spiral spring power storage amount, (4) much sectional space required.

Therefore, the present invention has been made in view of the above, and it is an object to provide a power reserve mechanism and indicator unit thereof which is (1) capable of reducing the number of parts, (2) easy to assemble, (3) obtain a freedom of a method of indicating a spiral spring power storage amount, (4) capable of reducing sectional space.

SUMMARY OF THE INVENTION

In order to achieve the above object, a power reserve mechanism comprises: a first power reserve wheel for obtaining rotation of a ratchet wheel through a train wheel; a first indicator member attached on the first power reserve wheel; a second power reserve wheel for obtaining rotation of a barrel complete through a train wheel; a second indicator member attached on the second power reserve wheel to change relative to the first indicator member; wherein a spiral spring power storage amount is indicated by a difference between the first indicator member and the second indicator member.

That is, a spiral spring power storage amount is indicated by a relative change of the first indicator member and the second indicator member. Where a remaining amount is indicated by one indicator member (indicator hand) as in the conventional, there is a need to rotate the one indicator member in respective directions thereby requiring a planetary gear mechanism. However, indication by a mere relative change requires rotation only in one direction. Accordingly, a planetary gear mechanism is not necessary. Also, the structure is simple because only relative change is made by the two indicator members. As a result, the number of parts can be reduced and assembling is facilitated. Also, indicator freedom increases. Furthermore, because it is possible to structure by simple two train wheels, space efficiency is good due to the planar structure.

An indicator unit of the power reserve mechanism is disposed coaxially relative to the first power reserve wheel connected to the first indicator member and the second power reserve wheel connected to the second indicator member, so that a spiral spring power storage amount is indicated by a difference between the first indicator member and the second indicator member. By this construction, it is possible to determine a spiral spring power storage amount from the relative position relationship between both indicator members. Furthermore, in order to transmit rotation to the indicator members, separate train wheels may be connected respectively from the ratchet wheel and the barrel complete.

In another a power reserve mechanism comprises: a first power reserve wheel for obtaining rotation of a ratchet wheel through a train wheel; a first indicator hand attached on the first power reserve wheel; a second power reserve wheel for obtaining rotation of a barrel complete through a train wheel; a second indicator hand attached on the second power reserve wheel to change relative to the first indicator hand; wherein a spiral spring power storage amount is indicated by a difference between the first indicator hand and the second indicator hand.

In this manner, each indicator member may, for example, be an indicator hand. Where indicating by indicator hands, a remaining amount can be determined by a spacing between the first indicator hand and the second indicator hand.

In another embodiment, a power reserve mechanism comprises: a first power reserve wheel for obtaining rotation of a ratchet wheel through a train wheel; a fun-shaped scale plate attached on the first power reserve wheel; a second power reserve wheel for obtaining rotation of a barrel complete through a train wheel; an indicator hand attached on the second power reserve wheel to change relative to the scale plate; wherein a spiral spring power storage amount is indicated by a division point of the scale plate pointed by the indicator hand.

In this manner, where the indicator member on a ratchet wheel side uses a fan-shaped scale plate and the indicator member on a barrel complete side uses an indicator hand, a remaining amount can be determined by a position of the indicator hand on the scale plate.

In another embodiment, a power reserve mechanism comprises: a first power reserve wheel for obtaining rotation of a ratchet wheel through a train wheel; an indicator hand attached on the first power reserve wheel; a second power reserve wheel for obtaining rotation of a barrel complete through a train wheel; a scale plate attached on the second power reserve wheel to change relative to the indicator hand; wherein a spiral spring power storage amount is indicated by a division point of the scale plate pointed by the indicator hand.

In this manner, where the indicator member on the ratchet wheel side uses an indicator hand and the indicator member on the barrel complete side uses a scale plate, a remaining amount can be determined by a position of the indicator hand on the scale plate.

In another embodiment, a power reserve mechanism comprises: an intermediate power reserve train wheel for transmitting rotation of a ratchet wheel; a first power reserve wheel for obtaining rotation from the first intermediate power reserve train wheel; a first indicator member attached on the first power reserve wheel; an intermediate second power reserve train wheel for transmitting rotation of a barrel complete; a second power reserve wheel for obtaining rotation from the intermediate second power reserve train wheel; a second indicator member attached on the second power reserve wheel to change relative to the first indicator member; wherein a spiral spring power storage amount is indicated by a difference between the first indicator member and second indicator member.

By this structure, a remaining amount can be indicated by a relative position of the first indicator member and the second indicator member. Accordingly, a planetary gear structure is not necessarily provided in order to obtain rotation in respective directions. Also, a power reserve mechanism can be structured by a simple train wheel. As a result, the number of parts can be educed and assembling is facilitated. Also, indicator freedom increases. Furthermore space efficiency is good because of the planar structure.

Also, an indicator unit for a power reserve mechanism according to claim 7 is structured coaxially by a first power reserve wheel attached with a first indicator member and a second power reserve wheel attached with a second indicator member, and characterized in that a spiral spring power storage amount is indicated by a difference between the first indicator member of the first power reserve wheel and second indicator member of the second power reserve wheel.

If the first indicator member and the second indicator member are coaxially structured, a spiral spring power storage amount can be determined from a relative position relationship between the both members. Incidentally, in order to transmit rotation to the both members, separate train wheels may be connected respectively from the ratchet wheel and the barrel complete.

Also, an indicator unit for a power reserve mechanism according to claim 8 is structured, in the above power reserve mechanism indicator unit, such that the first indicator member is an indicator hand or scale plate, and the second indicator member being a scale plate or indicator hand.

In this manner, the indicator members include an indicator hand and a scale plate. The indicator hands may be respective scale plates or a combination of an indicator hand and a scale plate.

DETAILED DESCRIPTION OF THE PREFERRED EMBODIMENT

Hereunder, the present invention will be explained in detail with reference to the drawings. Incidentally, the invention is not limited to by this embodiment.

Figure 1:
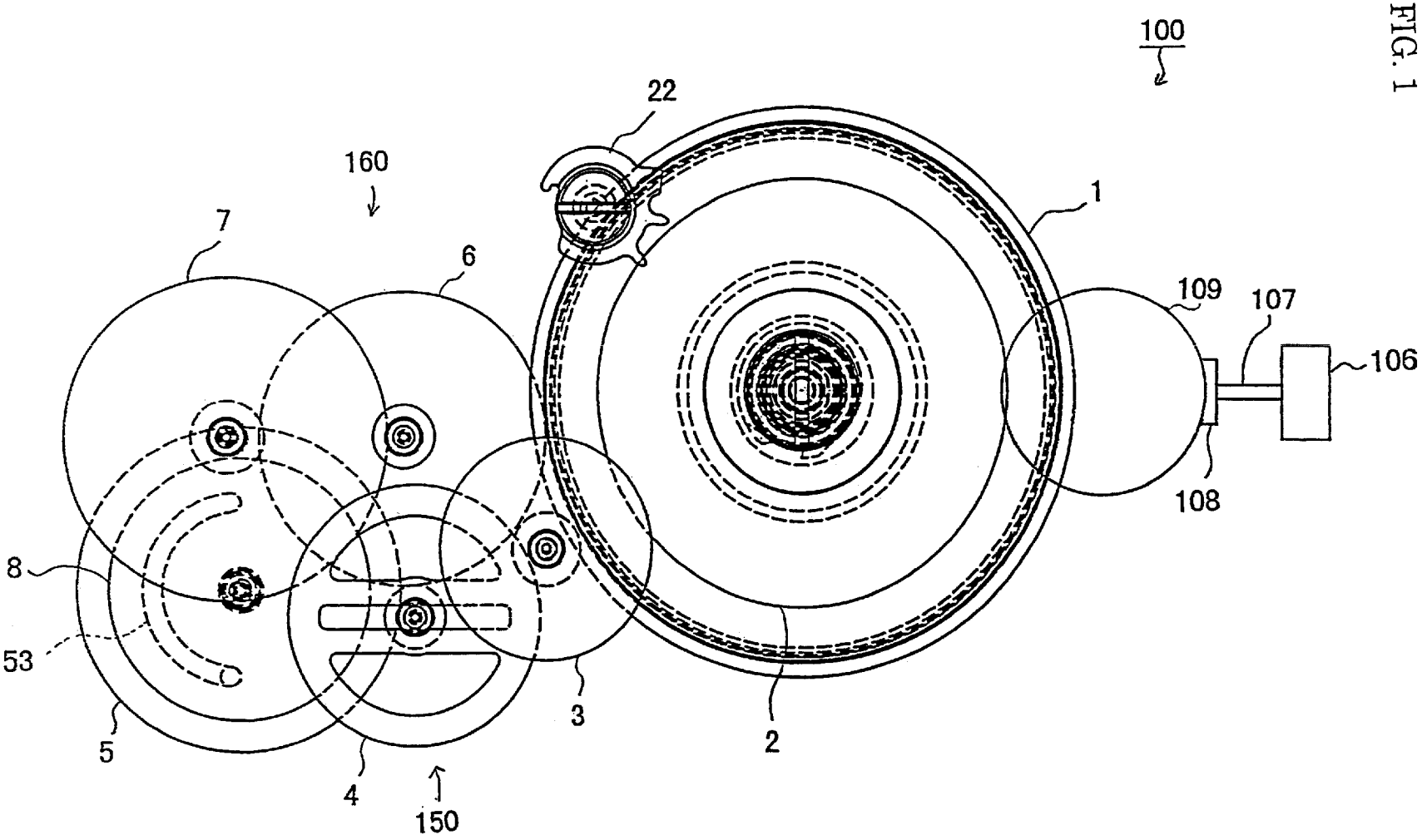
FIG. 1 is a top view showing a power reserve mechanism of this invention.
Figure 2:
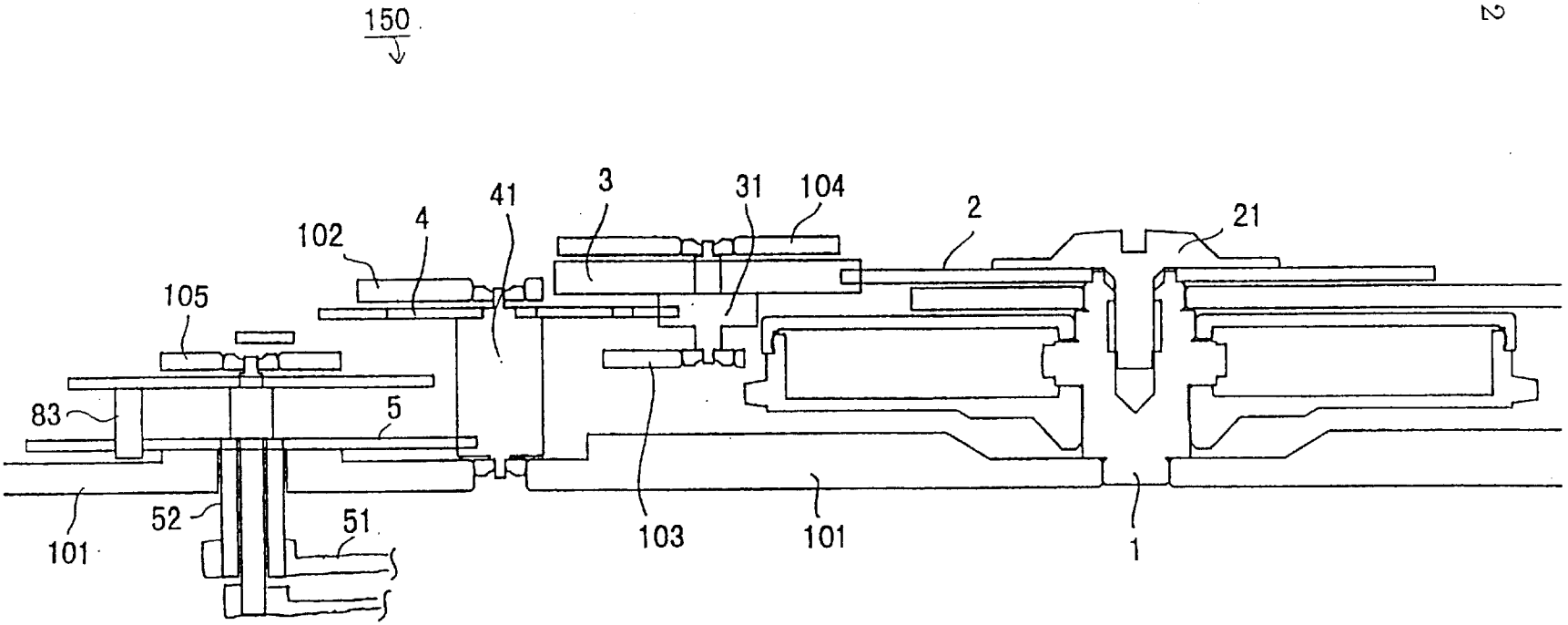
FIG. 2 is a top view showing first power reserve train wheel of the power reserve mechanism shown in FIG. 1.
Figure 3:
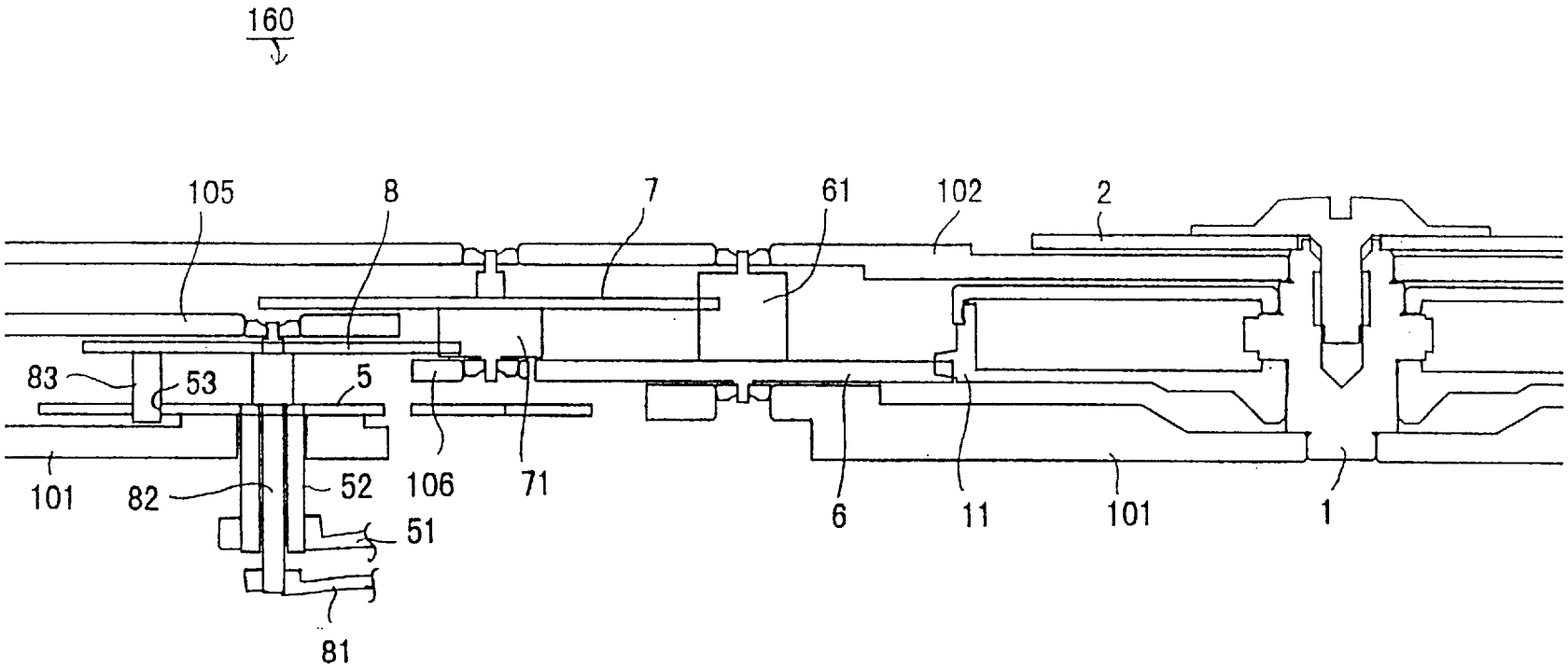
FIG. 3 is a top view showing a second power reserve train wheel of the power reserve mechanism shown in FIG. 1.

FIG. 1 is a top view showing a power reserve mechanism of the invention. FIG. 2 is a sectional view showing a first power reserve train wheel of the power reserve mechanism shown in FIG. 1. FIG. 3 is a sectional view showing a second power reserve train wheel of the power reserve mechanism shown in FIG. 1. In FIG. 1 a main plate is omitted. A power reserve mechanism 100 of the invention is provided separately with a first power reserve train wheel 150 and a second power reserve train wheel 160. Each train wheel has a power reserve wheel provided with an indicator hand to indicate an amount of spiral spring storage power.

Referring to FIG. 1 and FIG. 2, the first power reserve train wheel is first explained. The first power reserve train wheel 150 is structured by a ratchet wheel 2 attached to a dial plate side of a barrel complete 1, an intermediate first power reserve wheel 3 in mesh with this ratchet wheel 2, an intermediate second power reserve wheel 4 in mesh with an intermediate first power reserve wheel pinion 31 of the intermediate first power reserve wheel 3, and a first power reserve wheel 5 in mesh with an intermediate second power reserve wheel pinion 41 of the intermediate second power reserve wheel 4. This first power reserve wheel 5 which is structured to slip when a predetermined torque difference occurs in a contact plane between the gear and the pinion 41, is mounted with a first indicator hand 51. The ratchet wheel 2 is fixed on a shaft of the barrel complete 1 through a ratchet screw 21. The intermediate power reserve wheel 3 is rotatably supported at its shaft between a power reserve wheel bridge 103 and a third bridge 104. The intermediate first second power reserve wheel 4 is rotatably supported at its shaft between a main plate 101 and a barrel bridge 102. The first power reserve wheel 5 is rotatably assembled between the main plate 101 and the power reserve wheel bridge 105, and the main plate 101 serves as a bearing for the power reserve hour part 52. Also, the first power reserve wheel 5 is opened with an elongate hole 53 in which a pin 83 for the power reserve wheel, hereinafter described, is to be inserted.

Next, the second power reserve train wheel 160 is explained with reference to FIG. 1 and FIG. 3. The second power reserve train wheel 160 is structured by a barrel member (herein after "barrel complete") 1 accommodating a spiral spring as a power source, an intermediate third power reserve wheel 6 in mesh with a barrel complete gear 11 provided around the barrel complete 1, an intermediate fourth power reserve wheel 7 in mesh with an intermediate third power reserve wheel pinion 61 of the intermediate third power reserve wheel 6, and a second power reserve wheel 8 in mesh with an intermediate fourth power reserve wheel pinion 71 of the intermediate fourth power reserve wheel 7. This second power reserve wheel 8 is mounted with a second indicator hand 81. The barrel complete 1 is rotatably supported at its shaft between the main plate 101 and the barrel bridge 102. The intermediate third power reserve wheel 6 is rotatably supported at its shaft between the main plate 101 and the barrel bridge 102. The intermediate fourth power reserve wheel 7 are rotatably supported at its shaft between the second wheel bridge 106 and the barrel bridge 102. The second power reserve wheel 8 is rotatably assembled between the main plate 101 and the power reserve wheel bridge 105. Also, this second power reserve wheel 8 has at a shaft part 82 an hour part 52 of the first power reserve wheel 5 and penetrates through the hour part 52. Also, the second power reserve wheel 8 is provided with a projecting power reserve wheel pin 83. The power reserve wheel pin 83 is inserted through an elongate hole 53 of the first power reserve wheel 5 and restricted in movement by a shape of the elongate hole 53.

A reference numeral 106 is a crown. The crown 106 is attached to one end of a hand setting stem 107. This hand setting stem 107 has at the other end a winding pinion 108. The winding pinion 108 is in mesh with a crown wheel 109 to alter a rotation axis direction by 90 degrees. The crown wheel 109 is in mesh with a ratchet wheel 2 to convey rotation from the crown 106 to the ratchet wheel 2. Also, the ratchet wheel 2 is attached with a click 22 to regulate rotation of the ratchet wheel 2 to one direction. Incidentally, the first power reserve train wheel 150 and the second power reserve train wheel 160 both do not use a planetary wheel mechanism.

Figure 4:
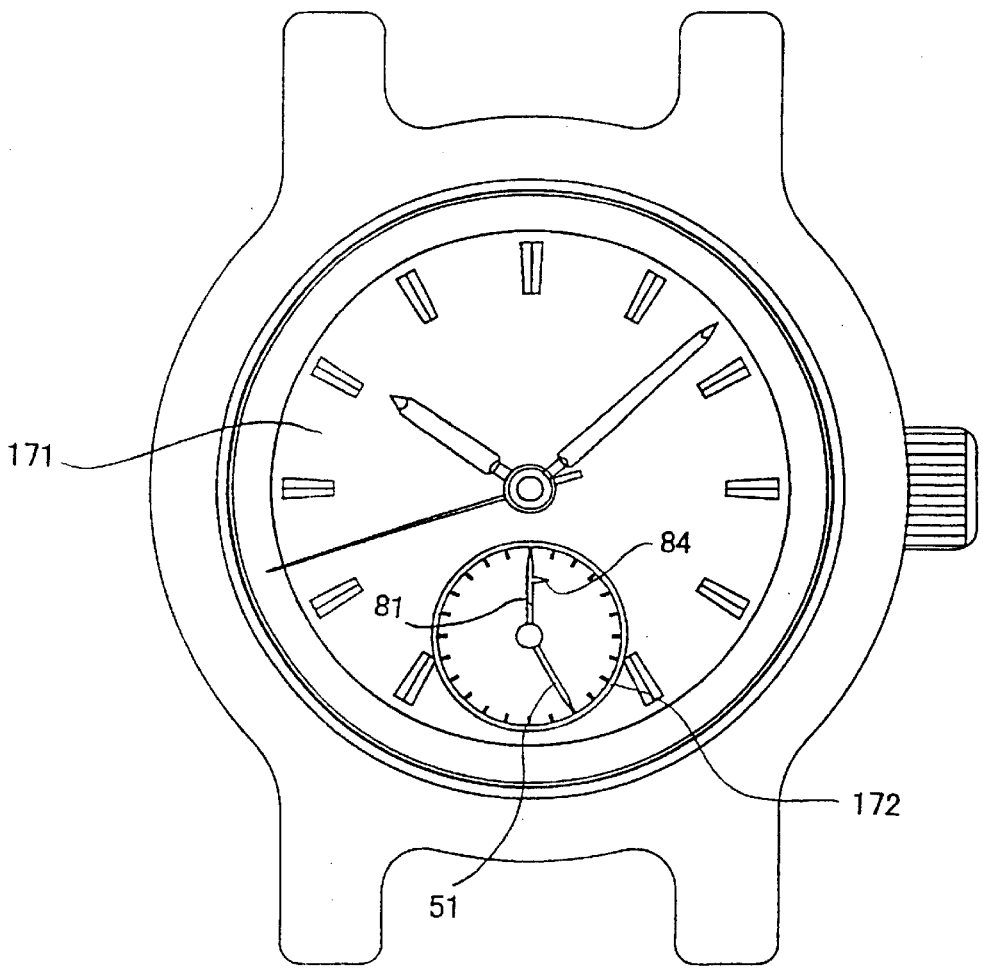
FIG. 4 is a top view showing indicator hands of the power reserve mechanism.

FIG. 4 is a top view showing an indicator hand for the power reserve mechanism 100. An example is shown with a dial 171 for a three hand watch. The dial 171 after assembling is positioned under the main plate. A reference numeral 172 is a remaining amount indicator part to indicate an amount of spiral spring storage power. The remaining amount indicator part 172 is arranged at an eccentric position from a center of the dial 171. A first indicator hand 51 and a second indicator hand 81 respectively use small hands. Particularly, the second indicator hand 81 is formed with a teaching part 84 to represent a direction for determining a remaining amount. Incidentally, although a scale plate may be used in place of the indicator hands, a concrete example thereof will be described hereafter.

Next, the operation of the power reserve mechanism 100 is explained.

[In Spiral Spring Power Storage]

The crown 106 if rotated transmits its rotation to the crown wheel 109 through the winding stem 107 and winding pinion 108. Because the crown wheel 109 and the ratchet wheel 2 are meshed with, the rotation of the crown wheel 109 rotates the ratchet wheel 2. The ratchet wheel 2 is regulated in direction of rotation by the click 22. Due to this, the ratchet wheel 2 will not be reversely rotated by a force of the spiral spring. The ratchet wheel 2 if rotated transmits its rotation to the intermediate first power reserve wheel 3. Since the intermediate first power reserve wheel pinion 31 meshes with the intermediate second power reserve wheel 4, the rotation of the intermediate first power reserve wheel 3 is transmitted to the intermediate second power reserve wheel 4. Because the intermediate second power reserve wheel pinion 41 meshes with the first power reserve wheel 5, the rotation of the intermediate second power reserve wheel 4 is transmitted to the first power reserve wheel 5. The rotation of the ratchet wheel 2 is reduced as transmitted through the intermediate first power reserve wheel 3, intermediate second power reserve wheel 4 and first power reserve wheel 5. The rotation of the first power reserve wheel 5 causes the first indicator hand 51 mounted on its hour part 52 to rotate over the remaining amount indicator part 172 in the dial 171.

On the other hand, the second indicator hand 81 is almost in an non-rotation state. This is because the barrel complete 1 is very slow in rotation and accordingly the train wheel formed by the intermediate third power reserve wheel 6, intermediate fourth power reserve wheel 7 and second power reserve wheel 8 is regulated in rotation thus placing the second power reserve wheel 8 substantially in a fixed state. Due to this, as shown in FIG. 4 the first indicator hand 51 and the second indicator hand 81 have an increased spacing due to rotation of the first indicator hand 51. The first indicator hand 51 and the second indicator hand 81 are restricted in their maximum spacing by engagement of the elongate hole 53 of the first power reserve wheel 5 with the power reserve wheel pin 83 of the second power reserve wheel 8.

[In Normal Hand Movement]

In normal hand movement the ratchet wheel 2 will not rotate. This is because the click 22 regulates against reverse rotation. Accordingly, the train wheel formed by the intermediate first power reserve wheel 3, intermediate second power reserve wheel 4 and first power reserve wheel 5 is regulated in rotation and the first power reserve wheel 5 is substantially a fixed wheel. Therefore, the first indicator hand 51 put on the first power reserve wheel 5 remains fixed at the rotated position. If the barrel complete 1 now rotates, its rotation is transmitted to the intermediate third power reserve wheel 6. Because the intermediate third power reserve wheel pinion 61 is in mesh with the intermediate fourth power reserve wheel 7, the rotation of the intermediate third power reserve wheel 6 is transmitted to the intermediate fourth power reserve wheel 7. Also, because the intermediate fourth power reserve wheel pinion 71 meshes with the second power reserve wheel 8, the rotation of the intermediate fourth power reserve wheel 7 is transmitted to the second power reserve wheel 8. The rotation of the barrel train 1 is reduced through the intermediate third power reserve wheel 6, intermediate fourth power reserve wheel 7 and second power reserve wheel 8. If the second power reserve wheel 8 rotates, the second indicator hand 81 put on its shaft part 82 rotates over the remaining amount indicator part 172 of the dial 171. The rotational direction of the second indicator hand 81 becomes same as the rotational direction of the first indicator hand 51. Consequently, the rotation of the second indicator hand 81 reduces the spacing to the first indicator hand 51. At a time point of agreement between the second indicator hand 81 and the first indicator hand 51, it can be found that there is no remaining amount on the spiral spring.

As described above, according to this power reserve mechanism 100, the first indicator hand 51 and the second indicator hand 81 are rotated in the same direction to have a spacing between the both thereby indicating a remaining amount on the spiral spring. Thus, there is no need to use a planetary mechanism for each train wheel. Due to this, it is possible to reduce the number of parts for the power reserve mechanism 100. Also, the structure is simple and hence easy to assemble. Furthermore, sectional spacing can be reduced.

Figure 5:
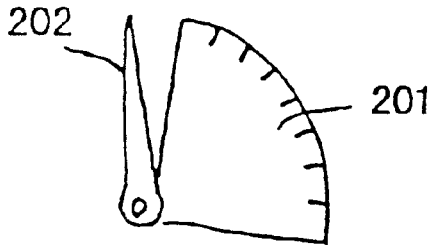
FIGS. 5(*a*)–5(*c*) are explanatory views showing an indication example of a spiral spring remaining amount.
Figure 5:
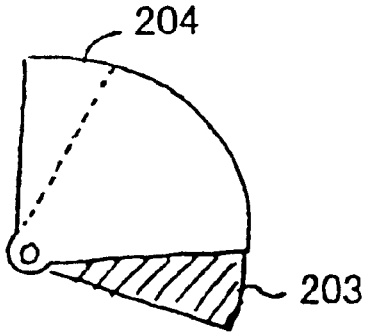
Figure 5:
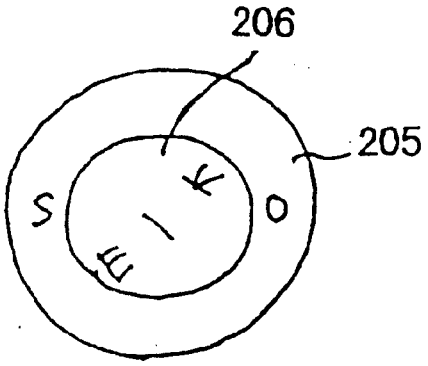
Figure 6:
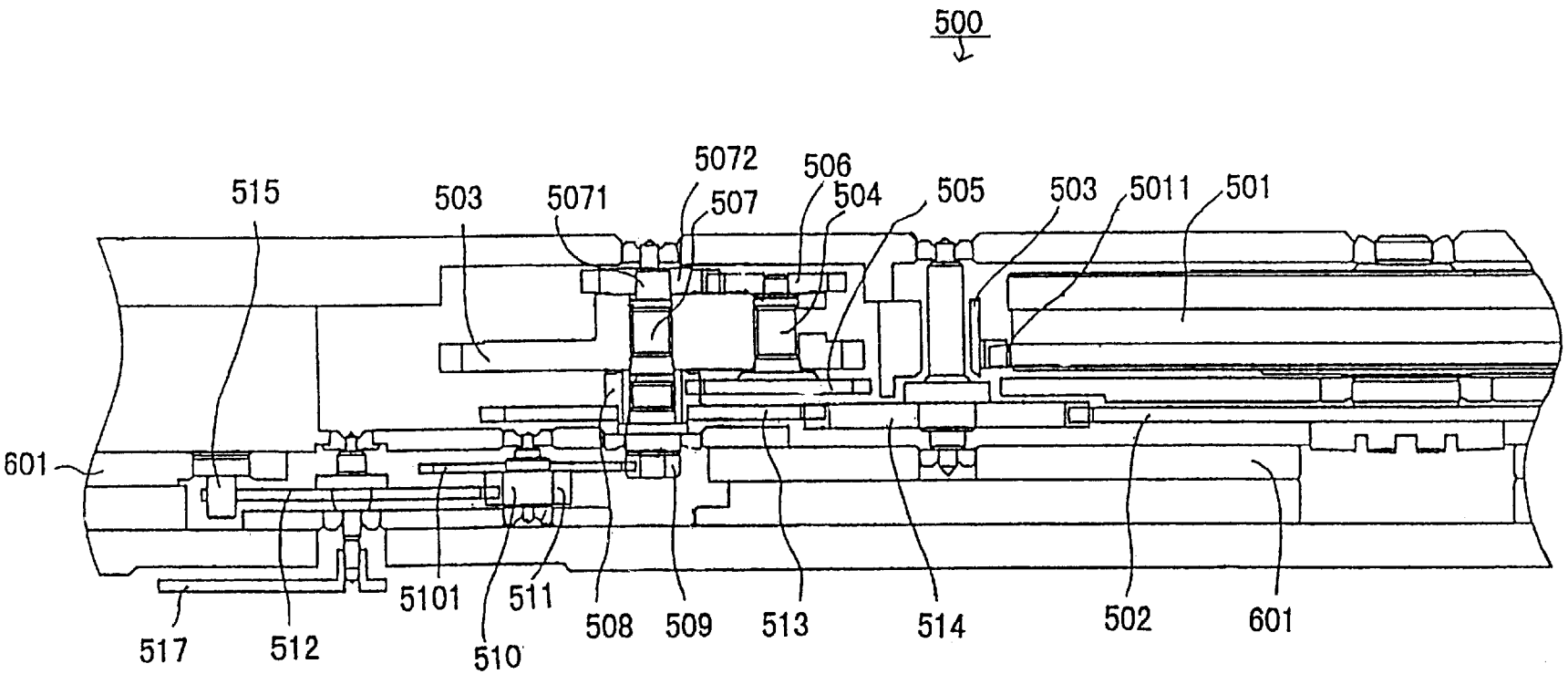
FIG. 6 PRIOR ART
FIG. 6 is a top view showing a conventional power reserve mechanism.
Figure 7:
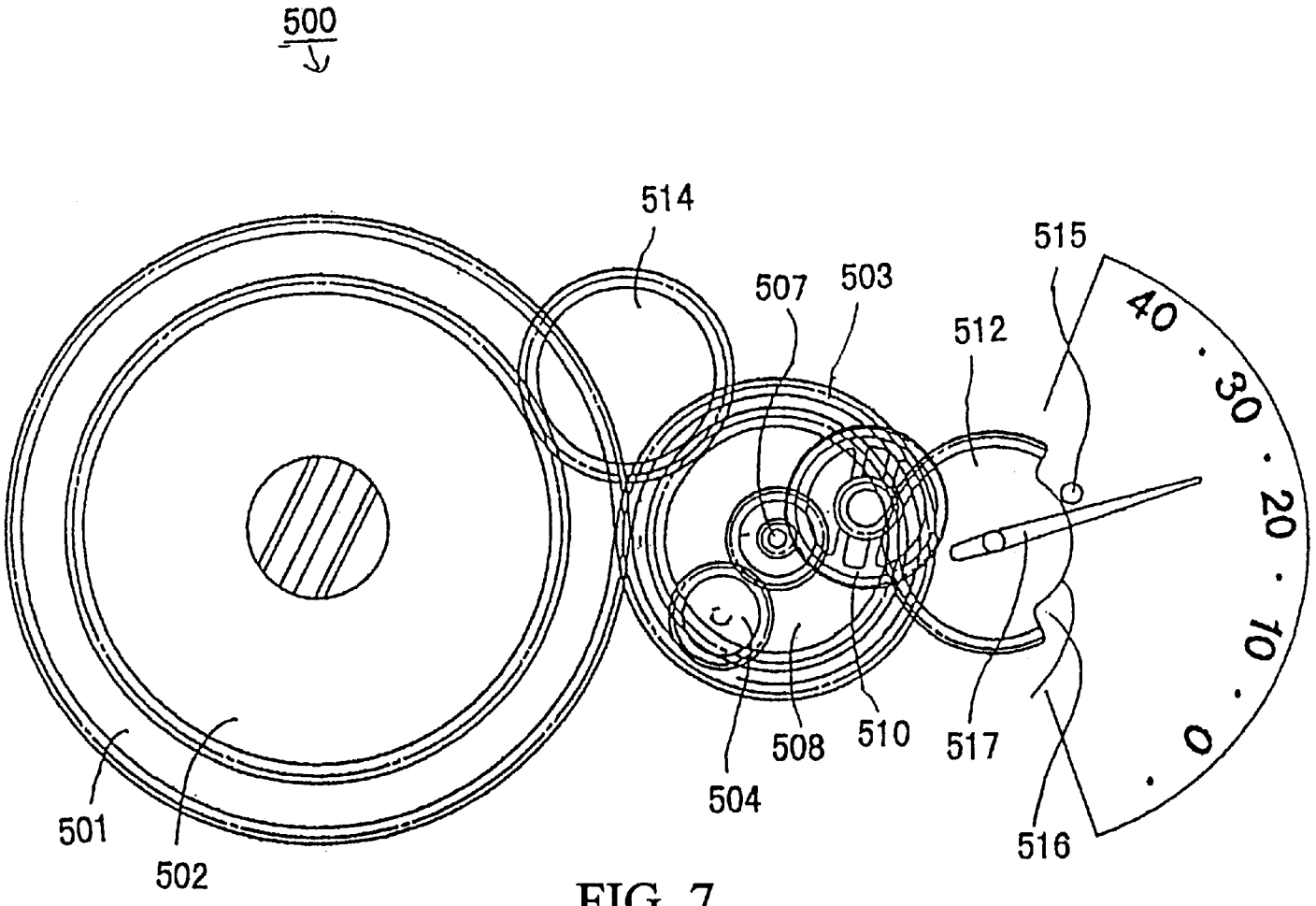
FIG. 7 PRIOR ART
FIG. 7 is a top view showing a power reserve mechanism shown in FIG. 6.

FIG. 5 shows an explanatory view showing an example of indicating a power storage amount on the spiral spring. As shown in (a) of the figure, a fan-shaped scale plate 201 may be attached to the first power reserve wheel 5 and an indicator hand 202 be on the second power reserve wheel 8. This makes it possible to indicate a spiral spring power storage amount by a position of the indicator hand 202 over the scale plate 201. Also, fan-shaped scale plates may be mounted on the first power reserve wheel 5 and the second power reserve wheel 8. This also can indicate a spiral power storage amount due to a relative change of position between the scale plates.

Also, colors may be provided to the scale plate to give indication with change of color. As shown in (b) of the figure, for example scale plates 203, 204 are given different colors that are mounted on the first power reserve wheel 5 and second reserve power wheel 8 so that one scale plate 203 covers over the other scale plate 204. In this case, when one color becomes invisible, it can be judged that there is no amount of spiral spring storage power. Incidentally, regardless of the above example shown in the figure, the member is not limited to the indicator hand or scale plate provided that relative change is to be found. For example, as shown in (c) of the figure, circular indicator plates 205, 206 may be attached to the first power reserve wheel 5 and second power reserve wheel 8 to add design elements.

As explained above, according to a power reserve mechanism of the invention, respective train wheels for rotating the first indicator member and the second indicator member are provided independently and in parallel so that a spiral spring power storage amount is indicated by a relative change of the first indicator member and the second indicator member. Accordingly, the power reserve mechanism is simple in structure. Due to this, the number of parts can be reduced and assembling is facilitated. Also, indication freedom increases. Furthermore, space efficiency is good due to the planar structure.

Also, because the first indicator member and the second indicator member are coaxially structured, a spiral spring power storage amount can be determined from the relative position relationship of both indicator members rotating about the same axis. This indicator unit is adapted for the above power reserve mechanism.

According to a next power reserve mechanism, because the indicator members use indicator hands, a remaining amount can be determined by a spacing between the first indicator hand and the second indicator hand.

According to a next power reserve mechanism because the indicator member on a ratchet wheel side uses a fan-shaped scale plate and the indicator member on a barrel complete side uses an indicator hand, a remaining amount can be determined by a position of the indicator hand on the scale plate.

According to a next power reserve mechanism, because the indicator member on the ratchet wheel side uses an indicator hand and the indicator member on the barrel complete side uses a scale plate, a remaining amount can be determined by a position of the indicator hand on the scale plate.

According to a next power reserve mechanism, independently provided are an intermediate first power reserve train wheel for transmitting rotation of a ratchet wheel and a first power reserve wheel and an intermediate second power reserve train wheel for transmitting rotation of a barrel complete and a second power reserve wheel. The first power reserve wheel and the second power reserve wheel of each train wheel are respectively provided with a first indicator member and a second indicator member so that a spiral spring power storage amount is indicated by a relative change between the first indicator member and second indicator member. Due to this, the power reserve mechanism is made simple in structure. Due to this, the number of parts can be educed and assembling is facilitated. Also, indication freedom increases. Furthermore space efficiency is good because of the planar structure.

According to a next power reserve mechanism, because a first indicator member and a second indicator member are coaxially structured. Accordingly it is possible to determine a spiral spring power storage amount from a relative position relationship between the both indicator member rotating about a same axis. This indicator unit is adapted for the above power reserve mechanism.

According to a next power reserve mechanism (claim 7), because the first indicator member is an indicator hand or scale plate, and the second indicator member being a scale plate or indicator hand. Accordingly, it is possible to indicate a spiral spring power storage amount in an intelligibly manner.

What is claimed is:

1. A power reserve mechanism comprising:

a ratchet wheel mounted for undergoing rotation;

a first power reserve wheel for undergoing rotation with the ratchet wheel;

a first gear train for transmitting rotation of the ratchet wheel to the first power reserve wheel;

a first indicator member disposed on the first power reserve wheel for rotation therewith;

a barrel member;

a spring member mounted in the barrel member;

a second power reserve wheel for undergoing rotation with the barrel member;

a second gear train for transmitting rotation of the barrel member to the second power reserve wheel;

a second indicator member disposed on the second power reserve wheel for rotation herewith and cooperating with the first indicator member to indicate an amount of spring power stored by the spring member in accordance with a relative variation in movement between the first and second indicator members;

slip means for slipping when there is a preselected torque difference between the first power reserve wheel and the first gear train; and restricting means for restricting a phase difference between the first power reserve wheel and the second power reserve wheel.

2. A power reserve mechanism according to claim 1; wherein the first and second power reserve wheels are mounted coaxially relative to one another.

3. A power reserve mechanism according to claim 1; wherein the first indicator member comprises a first indicator hand and the second indicator member comprises a second indicator hand.

4. A power reserve mechanism according to claim 1; wherein the first indicator member comprises a scale plate and the second indicator member comprises an indicator hand.

5. A power reserve mechanism according to claim 1; wherein the first indicator member comprises an indicator hand and the second indicator member comprises a scale plate.

6. A power reserve mechanism according to claim 1; wherein the first indicator member comprises a first scale plate and the second indicator member comprises a second scale plate.

7. A power reserve mechanism according to claim 1; wherein the first gear train has a first intermediate gear in meshing engagement with the ratchet wheel and a second intermediate gear in meshing engagement with the first intermediate gear and having a pinion in meshing engagement with the first power reserve wheel.

8. A power reserve mechanism according to claim 7; wherein the slip means comprises the second intermediate gear and the pinion of the second intermediate gear.

9. A power reserve mechanism comprising:

a ratchet wheel having a winding stem;

a first winding stem train wheel connected to the winding stem of the ratchet wheel and having a first power reserve wheel;

a barrel member having a winding stem;

a spring member mounted in the barrel member;

a second winding stem train wheel independent from the first winding stem train wheel and connected to the winding stem of the barrel member, the second winding stem train wheel having a second power reserve wheel;

a first indicator disposed on the first power reserve wheel;

a second indicator disposed on the second power reserve wheel;

display means for displaying an amount of spring power stored by the spring member in accordance with a relative variation in movement between the first and second indicators; and slip means for slipping when there is a preselected torque difference between the first power reserve wheel and one other wheel of the first winding stem train wheel.

10. A power reserve mechanism according to claim 9; wherein the first indicator comprises a first indicator hand and the second indicator comprises a second indicator hand.

11. A power reserve mechanism according to claim 9; wherein the first indicator comprises a first scale plate and the second indicator comprises a second scale plate.

12. A power reserve mechanism according to claim 9; wherein the first indicator comprises an indicator hand and the second indicator comprises a scale plate.

13. A power reserve mechanism according to claim 9; wherein the first indicator comprises a scale plate and the second indicator comprises an indicator hand.

14. A power reserve mechanism according to claim 9; wherein the first winding stem train wheel has a first intermediate gear in meshing engagement with the ratchet wheel and a second intermediate gear in meshing engagement with the first intermediate gear, the second intermediate gear having a pinion in meshing engagement with the first power reserve wheel.

15. A power reserve mechanism according to claim 14; wherein the slip means comprises the second intermediate gear and the pinion of the second intermediate gear.

16. A power reserve mechanism according to claim 9; wherein the first and second power reserve wheels are mounted coaxially relative to one another.

17. A power reserve mechanism comprising:

a first power reserve wheel train comprised of a ratchet wheel mounted for undergoing rotation, a first intermediate wheel in meshing engagement with the ratchet wheel and having a first pinion, a second intermediate wheel in meshing engagement with the first pinion and having a second pinion, and a first power reserve wheel in meshing engagement with the second pinion;

a second power reserve wheel train comprised of a barrel member having a gear, a third intermediate wheel in meshing engagement with the gear of the barrel member and having a third pinion, a fourth intermediate gear in meshing engagement with the third pinion and having a fourth pinion, and a second power reserve wheel in meshing engagement with the fourth pinion;

a spring member mounted in the barrel member;

a first indicator disposed on the first power reserve wheel;

a second indicator disposed on the second power reserve wheel; and display means for displaying an amount of spring power stored by the spring member in accordance with a relative variation in movement between the first and second indicators.

18. A power reserve mechanism combination according to claim 17; wherein the first indicator comprises a first indicator hand and the second indicator comprises a second indicator hand.

19. A power reserve mechanism according to claim 17; wherein the first indicator comprises a first scale plate and the second indicator comprises a second scale plate.

20. A power reserve mechanism according to claim 17; wherein the first indicator comprises an indicator hand and the second indicator comprises a scale plate.

21. A power reserve mechanism according to claim 17; wherein the first indicator comprises a scale plate and the second indicator comprises an indicator hand.

22. A power reserve mechanism according to claim 17; further comprising slip means for slipping when there is a preselected torque difference between the first power reserve wheel and the second intermediate wheel.

23. A power reserve mechanism according to claim 22; wherein the slip means comprises the second intermediate wheel and the second pinion.

24. A power reserve mechanism according to claim 22; further comprising restricting means for restricting a phase difference between the first power reserve wheel and the second power reserve wheel.

25. A power reserve mechanism according to claim 24; wherein the restricting means comprises a slot formed in the first power reserve wheel and a pin projecting from the second power reserve wheel and extending into the slot of the first power reserve wheel.

26. In a timepiece having a spring member as a power source for the timepiece: a power reserve mechanism for indicating an amount of spring power stored by the spring member, the amount of spring power being representative of the power reserve of the timepiece, the power reserve mechanism comprising a first power reserve wheel train comprised of a ratchet wheel mounted for undergoing rotation, a first intermediate wheel in meshing engagement with the ratchet wheel and having a first pinion, a second intermediate wheel in meshing engagement with the first pinion and having a second pinion, and a first power reserve wheel in meshing engagement with the second pinion; a second power reserve wheel train comprised of a barrel member having a gear and to which the spring member is mounted, a third intermediate wheel in meshing engagement with the gear of the barrel member and having a third pinion, a fourth intermediate gear in meshing engagement with the third pinion and having a fourth pinion, and a second power reserve wheel in meshing engagement with the fourth pinion; a first indicator disposed on the first power reserve wheel; and a second indicator member disposed on the second power reserve wheel an cooperating with the first indicator member to indicate an amount of spring power stored by the spring member in accordance with a relative variation in movement between the first and second indicator members.

27. A combination according to claim 26; further comprising slip means for slipping when there is a preselected torque difference between the first power reserve wheel and the second intermediate wheel; an restricting means for restricting a phase difference bet ween the first power reserve wheel and the second power reserve wheel.

28. A combination according to claim 27; wherein the slip means comprises the second intermediate wheel and the second pinion; and wherein the restricting means comprises a slot formed in the first power reserve wheel and a pin projecting from the second power reserve wheel and extending into the slot of the first power reserve wheel.

* * * * *